United States Patent [19]

Olsson

[11] 4,034,319

[45] July 5, 1977

[54] COUPLED BAR MICROWAVE BANDPASS FILTER

[75] Inventor: David L. Olsson, Manhattan Beach, Calif.

[73] Assignee: TRW Inc., Redondo Beach, Calif.

[22] Filed: May 10, 1976

[21] Appl. No.: 684,804

[52] U.S. Cl. ..... 333/73 R; 333/73 S; 333/82 B

[51] Int. Cl.[2] ..... H01P 1/20

[58] Field of Search ..... 333/71, 73 R, 73 W, 333/73 S, 98 R, 82 B, 82 R

[56] References Cited

UNITED STATES PATENTS

| | | | |
|---|---|---|---|
| 2,954,536 | 9/1960 | Muller | 333/73 W |
| 3,137,828 | 6/1964 | Gerig et al. | 333/73 W |
| 3,609,598 | 9/1971 | Spaulding | 333/73 W X |
| 3,737,816 | 6/1973 | Honicke | 333/73 W |
| 3,818,389 | 6/1974 | Fisher | 333/73 R |

*Primary Examiner*—Paul L. Gensler
*Attorney, Agent, or Firm*—John J. Connors; Edwin A. Oser; Jerry A. Dinardo

[57] ABSTRACT

A microwave bandpass filter of the coupled bar type providing either an interdigital or combline structure. The filter consists of a plurality of resonator sections having two ground planes and a resonating bar integral with the structure and extending perpendicularly from one of the walls and parallel to the ground planes. The spacer sections match the dimensions of the resonator sections, but may have different widths thereby to control the spacing between adjacent resonator bars. Alternate resonator sections and spacer sections are mechanically interconnected to form a filter of the desired electrical properties.

6 Claims, 5 Drawing Figures

COUPLED BAR MICROWAVE BANDPASS FILTER

The invention herein described was made in the course of or under a contract or subcontract thereunder with the Department of the Air Force.

BACKGROUND OF THE INVENTION

This invention relates generally to microwave bandpass filters and particularly to a filter of the coupled bar type having desirable structural features.

Microwave bandpass filters are generally known. Among these are filters utilizing resonant bars which vibrate or resonate at a particular electrical frequency. Such filters may be made so that the resonant bars are disposed in the same plane in which case a combline structure results. Alternatively, the bars of alternate resonators may be on opposite spaced walls to provide an interdigital structure.

In filters of this type the resonant frequency depends principally upon the length of the resonator bar. This may be adjusted by means of tuning screws. On the other hand the bandwidth depends upon the spacing of adjacent bars and the bar width and thickness.

Particularly at the high end of the microwave range mechanical dimensions become critical and the random accumulation of mechanical tolerances may degrade the filter performance. Hence a filter made in accordance with conventional techniques may not have the desired electrical properties.

Furthermore, the resonator bars are mechanically and electrically connected to a mounting surface. Usually the bars and housing therefore are separately machined or manufactured. They must then subsequently be joined, for example, by soldering. The solder connection in turn may increase the electrical resistivity in a random manner. This, of course, degrades filter performance by introducing an additional unwanted loss.

Furthermore, such filters may have to be used in a hostile environment. This in turn may threaten the mechanical integrity of the filter because the resonator bar must be firmly secured to its mounting surface.

It has been found that microwave filters of this type particularly at the high end of the microwave frequency range are difficult to accurately produce. Furthermore, it is equally difficult to precisely achieve the desired spacing between adjacent bars which determines the bandwidth.

Concerning the general background of microwave filters and particularly of bandpass filters, reference is made to Chapter 10 of a book entitled "Microwave Filters, Impedance-Matching Networks, and Coupling Structures" by Matthaei et al. published by McGraw Hill Book Company 1964. Chapter 10 covers pages 583 to 650. Reference is particularly made to pages 614 to 631 dealing with interdigital-line filters. In this connection see particularly FIGS. 10.06-1 through 10.06-4 and FIGS. 10.07-1 to 10.07-3.

It is accordingly an object of the present invention to provide a coupled-bar microwave bandpass filter where problems due to electrical connections between the housing and the coupling bar are eliminated.

Another object of the present invention is to provide a simple and convenient construction which allows adjustment of the distances between adjacent resonant bars, facilitating experimental adjustment of filter parameters.

A further object of the present invention is to provide a bandpass filter of the type discussed that is of simple mechanical construction and which can be readily reproduced.

SUMMARY OF THE INVENTION

In accordance with the present invention, separate resonator sections and spacer sections are provided. The spacer sections may have different thicknesses whereby the distance between adjacent resonating bars can be readily adjusted.

Each resonator section consists of a metallic structure having four connected walls forming a hollow member of substantially rectangular cross-section. The resonator section provides two ground planes and a resonating bar integral with the structure and extending perpendicularly from one of the walls and parallel to the ground planes.

Since the resonator section is integral with the resonating bar the problems encountered in the past have been eliminated. Thus, the electrical resistivity remains uniform and the solder joints conventionally used between the housing and the bars which can deteriorate in hostile environments are eliminated. The spacer sections match the dimensions of the walls of a member, that is, of a resonator section. Finally, alternate resonator sections and spacer sections are mechanically interconnected to form a filter of predetermined properties.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawing.

DESCRIPTION OF THE PREFERRED EMBODIMENTS

Figure 1:
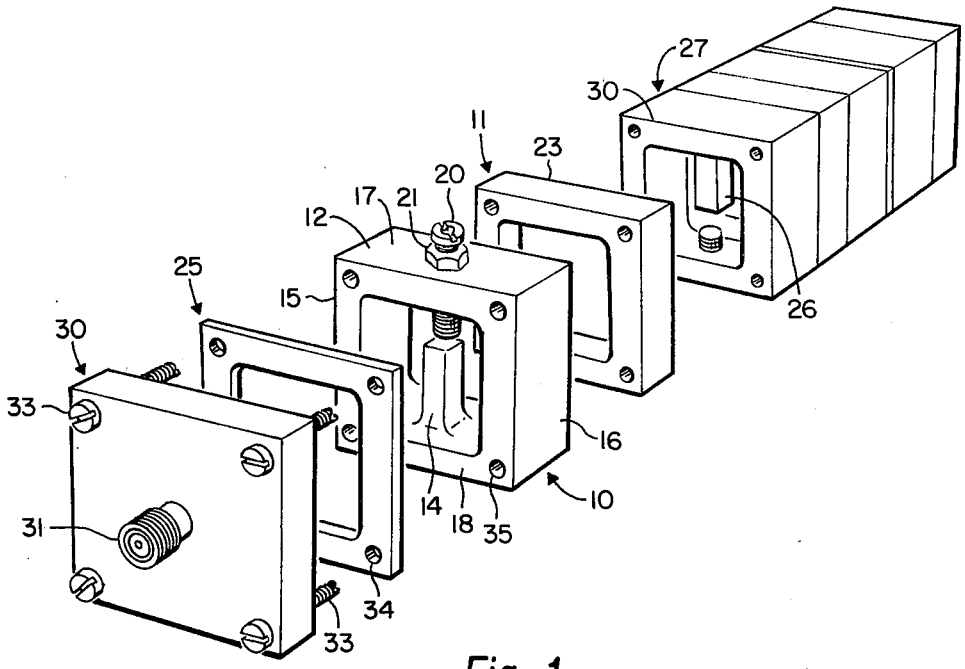
FIG. 1 is a partially exploded view in perspective of a microwave bandpass filter embodying the present invention.

Referring now to FIG. 1, there is illustrated a microwave bandpass filter in accordance with the present invention. The filter is of the coupled bar type and may either be realized as an interdigital or a combline filter. It can be designed for a frequency band ranging between 100 Mhz and 30 Ghz.

The filter consists basically of alternate resonator sections 10 and spacer sections 11. The resonator section 10 consists of a hollow metal housing 12 of generally rectangular cross-section. It is made integral with a resonating bar 14 to resonate at a desired electrical frequency. Thus the housing 12 and bar 14 may be machined from a solid block of metal. The housing 12 has two side walls 15 and 16 which form two ground planes. Disposed at right angles to the two side walls 15 and 16 are a top and a bottom wall 17 and 18.

The resonating bar 14 extends from the bottom wall 18 and is integral with the housing 12. It may be disposed in the center and equidistant from the two open ends of the resonator section. Alternatively, it may be displaced to one side, that is nearer to one opening than the other.

A tuning screw 20 may extend through the top wall 17 substantially coaxial with the resonating bar 14. It serves the usual purpose of fine tuning the frequency of the resonator section 10. Thus the frequency of the filter depends on the length of the resonating bar 14 and this can be changed or adjusted by screwing the tuning screw 20 toward or away from the resonating bar 14. It will be understood that the tuning screw may have a smooth plug-like end portion. A locking nut 21 may be disposed between the head of the tuning screw 20 and the upper wall 17 for locking the tuning screw in a desired position.

The spacer section 11 consists simply of a housing 23 of rectangular cross-section and providing an opening corresponding to that of the resonator section 10.

By way of example there is shown another spacer section 25 having a smaller width than the spacer section 11. This in turn will determine the spacing between adjacent resonating bars such as 14 and 26 of the next following resonator section 27.

It is well known that the bandwidth of the filter depends on the spacing between adjacent bars such as 14 and 26. This in turn can readily be varied by selecting a spacer section such as 11 or 25 with a greater or smaller width. This in turn facilitates the design or experimental adjustment of a suitable bandpass filter; it also makes it possible to adjust for unavoidable mechanical tolerances so as to obtain the desired electrical pass bandwidth.

Both the resonator sections such as 10 and 27 and the spacer sections such as 11 and 25 may be made of any suitable metal. For example, they may be machined from aluminum and provided with a highly conducting surface layer. For example, the aluminum may be plated with copper and gold.

The filter of FIG. 1 is also provided with two closure elements or end sections such as 30. The closure element 30 may consist of the same material as do the resonator sections and spacer sections. It is provided with an input or output means 31 for applying to the filter the microwave signal to be filtered or obtained therefrom or obtaining it therefrom.

The individual sections and the closure element may be mechanically connected to each other, for example, by a plurality of screws 33 extending through suitable holes such as 34 and 35 in the various sections to provide an electrically conductive and contiguous structure.

It will be noted that the resonating bar 14 extends from the lower wall 18 of the resonator section 10, while the resonating bar 26 extends from the upper wall 36 of the resonator section 27. Hence, the two resonator bars extend from the walls disposed in spaced, parallel planes. This structure will yield a so-called interdigital filter. When it is desired to provide a combline filter, all that needs to be done is to rotate the filter section 27 or 10 through 180°. In this case, the resonating bars extend from the walls of their resonator sections disposed in the same plane.

Figure 2:
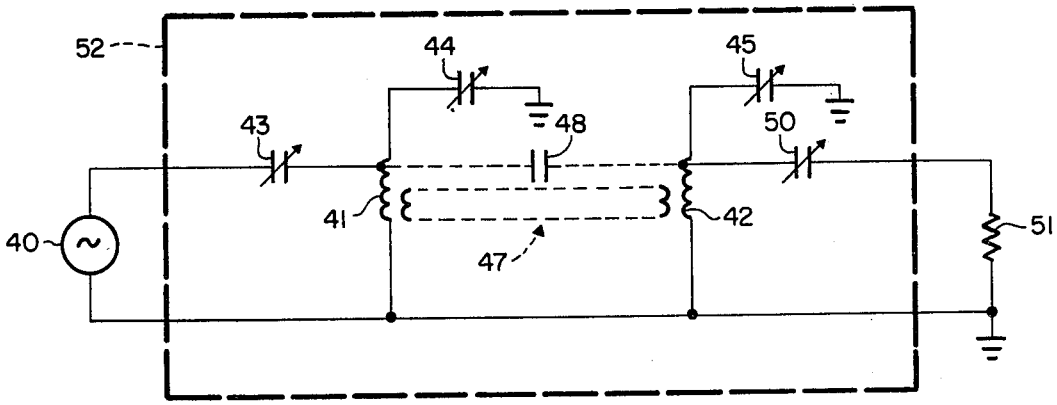
FIG. 2 is an equivalent circuit diagram of the bandpass filter of the invention.

Reference is now made to FIG. 2 which is an equivalent circuit of the structure of FIG. 1. The microwave signal is impressed upon the filter structure by a generator 40. The resonator bars such as 14 and 26 are the equivalent of the inductors 41 and 42. As will be explained hereinafter, the closure element 30 may also be provided with a tuning screw which is equivalent to a variable capacitor 43 connected in series with the generator 40 and the inductor 41.

The tuning screw of each resonator section forms the equivalent of a variable capacitor 44 and 45 connected respectively between one terminal of the inductor 41 and ground or one terminal of the inductor 42 and ground corresponding to a ground plane 15 or 16.

By virtue of the physical proximity of adjacent resonator bars 14 and 26, there is provided in inductive coupling indicated in dotted lines at 47 to the inductors 41 and 42. Alternatively there may be a capacitive coupling as shown in dotted lines by the capacitor 48. Finally a variable capacitor 50 may correspond to a tuning screw on the other closure element and connects the inductor 42 to ground through a load resistor 51 across which the filtered signal is developed. As indicated by the dotted box 52, an electrical shield is provided corresponding to the housing formed by the various sections.

Figure 3:
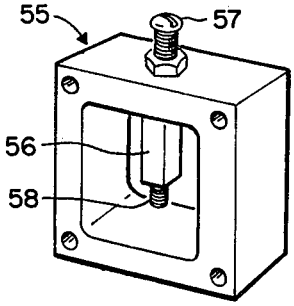
FIG. 3 is a view in perspective of a modification of a resonator section.

Referring now to FIG. 3, there is shown a modification of one of the resonator sections. Thus the resonator section 55 is provided with a resonating bar 56. A tuning screw 57 extends through the resonating bar 56 as shown at 58. This may be desirable in certain cases.

Figure 4:
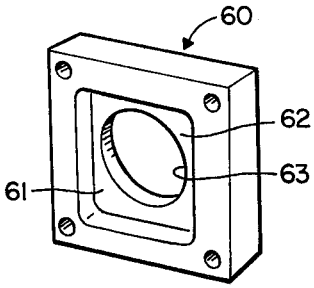
FIG. 4 is a view in perspective of an alternate form of a spacer section providing an iris.

As shown in FIG. 4, it is also feasible to provide a spacer section 60 with an internal iris 61 consisting of a thin-walled center portion 62 having a circular opening 63. Such an iris reduces the coupling between successive resonator sections. Hence, by utilizing an iris the thickness of the resonator section can be made smaller.

Figure 5:
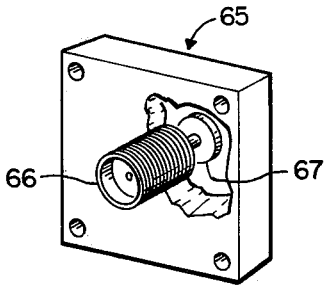
FIG. 5 is a view in perspective of an alternate form of an end section of the filter of the invention.

Finally FIG. 5 illustrates an end or closure section 65 which again has a coupling element 66. In addition it is provided with a mechanical capacitor probe 67 which is part of connector 66. This corresponds to either the variable capacitor 43 or 50 of the equivalent circuit of FIG. 2.

There has thus been disclosed a microwave bandpass filter of the coupled bar type. The filter of the invention provides better electrical conductance between each resonating bar and its resonator section. Due to the fact that the resonator section is made integral with its resonating bar, the mechanical integrity of the filter is maintained even in a hostile physical environment. A filter of the invention can be more easily realized over a wide frequency range because random accumulation of mechanical tolerances can be readily taken care of by selecting the proper width of the respective spacer sections. Furthermore, the filter of the invention can be readily assembled even at very high frequencies where the physical dimensions are small.

What is claimed is:

1. A microwave bandpass filter of the coupled bar type comprising:

a. a plurality of resonator sections, each consisting of a single unitary metallic structure having four connected walls forming a hollow member of substantially rectangular cross-section providing two ground planes and a resonating bar integral with said structure and extending from one of the walls parallel to the ground planes;

b. a plurality of spacer sections each matching the dimensions of the walls of a member and having a substantially rectangular cross-section; and c. means for connecting alternate resonator sections and spacer sections for forming a filter of predetermined properties.

2. A filter as defined in claim 1 wherein each of said resonator sections and spacer sections is provided with a high conductive metallic surface layer.

3. A filter as defined in claim 1 wherein the opening of one of said spacer elements is partially obscured to form an iris.

4. A filter as defined in claim 1 wherein a closure element is provided for said filter, and closure element having means for applying microwave energy thereto or removing it therefrom.

5. A filter as defined in claim 4 wherein said closure element is provided with a mechanically variable capacitor forming part of said means for applying and extending through a face of said closure element.

6. A filter as defined in claim 1 wherein said spacer sections have different, thicknesses thereby to control the bandwidth of the filter.

* * * * *